US005566041A

United States Patent [19]

Rumfield

[11] Patent Number: 5,566,041

[45] Date of Patent: Oct. 15, 1996

[54] ZERO-SEQUENCE OPENING OF POWER DISTRIBUTION

[75] Inventor: Lance T. Rumfield, Spring, Tex.

[73] Assignee: Houston Industries Incorporated, Houston, Tex.

[21] Appl. No.: 423,041

[22] Filed: Apr. 17, 1995

[51] Int. Cl.[6] ..... H01H 73/00

[52] U.S. Cl. ..... 361/115; 218/154

[58] Field of Search ..... 218/7, 14, 78, 218/84, 92, 140, 153, 154; 307/116, 117, 119, 132 E; 361/2, 3, 5, 6, 7, 56, 79, 83, 86, 88, 89, 93, 102, 115, 170, 173–177, 179

[56] References Cited

U.S. PATENT DOCUMENTS

| | | | |
|---|---|---|---|
| 4,306,263 | 12/1981 | Gray et al. | 361/3 |
| 4,513,208 | 4/1985 | Kamata | 361/115 |
| 4,745,512 | 5/1988 | Hampson | 361/36 |
| 4,825,327 | 4/1989 | Alexander et al. | 361/82 |
| 4,945,256 | 7/1990 | Tada et al. | 361/115 |
| 5,113,304 | 5/1992 | Ozaki et al. | 361/87 |
| 5,172,329 | 12/1992 | Rahman et al. | 364/483 |
| 5,309,312 | 5/1994 | Wilkerson et al. | 361/79 |
| 5,315,499 | 5/1994 | Bilas et al. | 364/483 |

*Primary Examiner*—Jeffrey A. Gaffin
*Assistant Examiner*—Ronald W. Leja
*Attorney, Agent, or Firm*—Pravel, Hewitt, Kimball & Krieger

[57] ABSTRACT

The phase of electrical current flowing through a power distribution network is sensed and fed to a computer. A transducer also detects the position and movement of an insulator rod used to mechanically open the contacts of a high voltage circuit breaker in the power distribution network. Signals indicative of insulator rod position and movement are also furnished to the computer. When it becomes necessary to open the circuit breaker contacts, the insulator rod movement and the electrical current phase are coordinated so that the contacts are carrying little, if any, current when they open. The fault-interrupting capacity of a circuit breaker is increased, while damage to the breaker contacts is reduced.

20 Claims, 1 Drawing Sheet

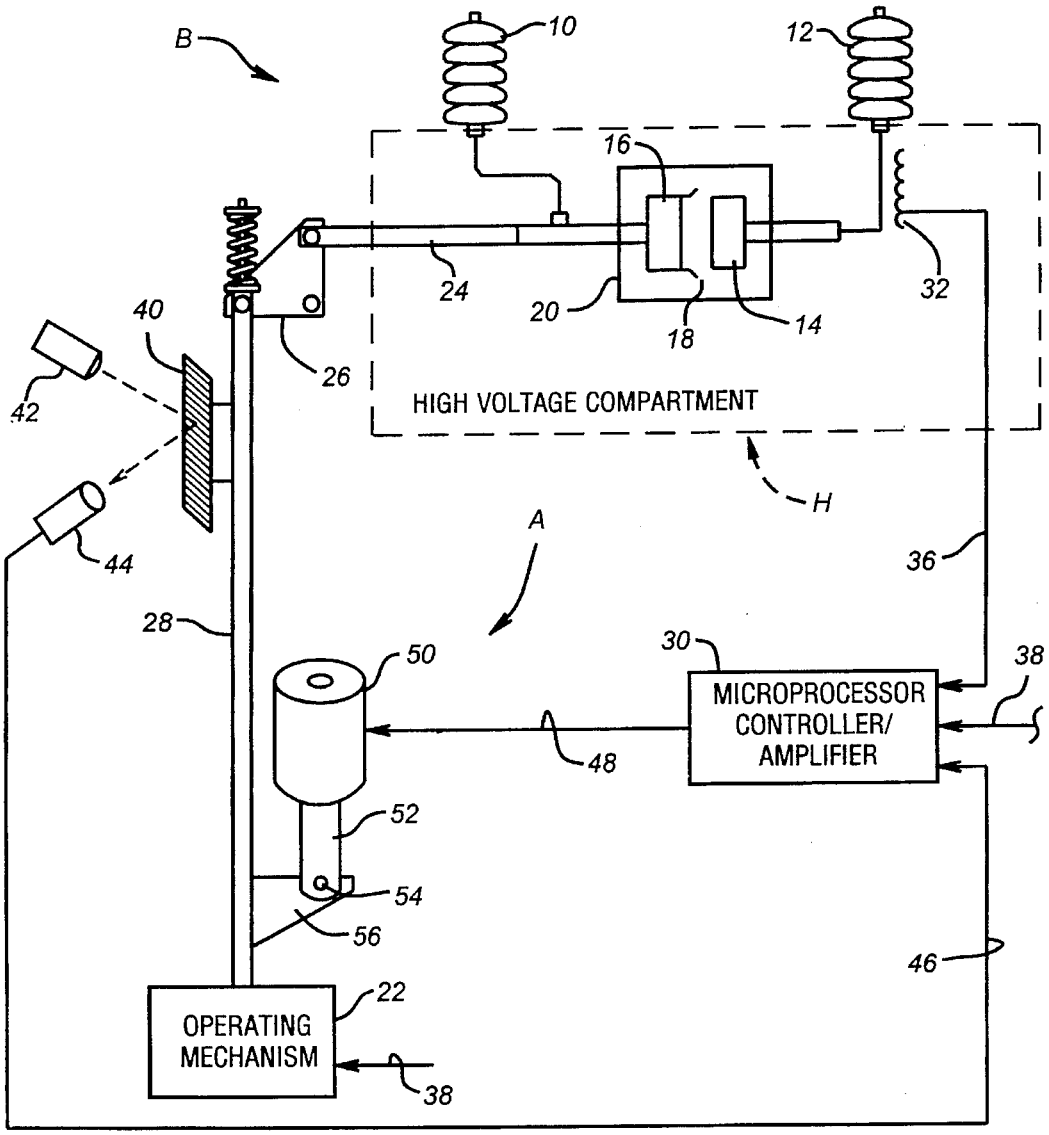
FIG. 1
FIG. 2
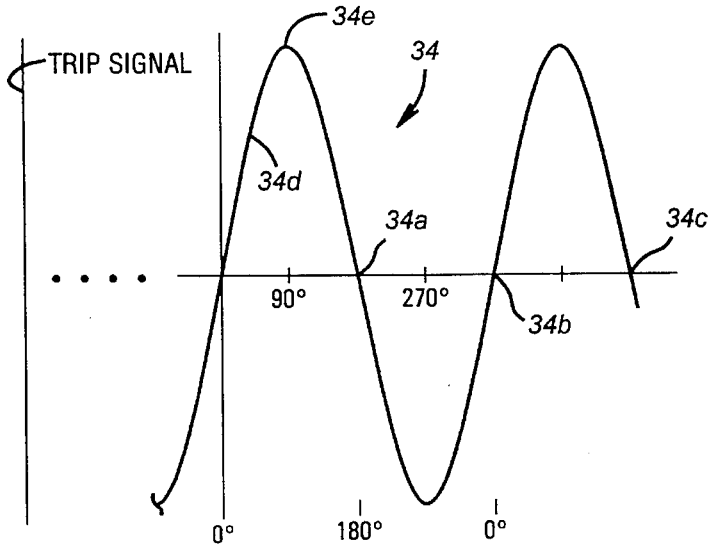

ZERO-SEQUENCE OPENING OF POWER DISTRIBUTION

BACKGROUND OF INVENTION

1. Field of Invention

The present invention relates to opening of circuit breakers in power distribution networks.

2. Description of the Prior Art

In large alternating current electrical power distribution networks, substation class circuit breakers have long been used both to close and to open or trip an electrical circuit. These types of circuit breakers have been typically rated in terms of their interrupting capacity, typically defined as the maximum instantaneous available fault current which a breaker has been rated to interrupt. Interrupting capacity has typically been measured in kiloamperes (kA).

Typical fault currents have been substantial and existing breaker technology has, so far as is known, relied on bulk and size in a breaker to handle interruption of the high fault current levels expected. For example, in a 69 kilovolt network, a fault current of 40 kiloamperes was a typical rating, while for a 138 kilovolt network a rated fault current was on the order of 80 kiloamperes.

In operation, as the electrical contacts parted, an alternating current electrical arc was established between a stationary contact and a moving contact element located in an insulating medium. As the electrical contacts parted, the arc was formed by ionization of the insulating medium as well as of the materials of the contact elements.

As the contact elements moved further from each other, the arc became elongated and was cooled by the insulating medium. Further provision was also usually made to cool and lengthen the arc, either by magnetically or mechanically applied forces. As the arc length cooled and lengthened, the resistance of the arc path increased. At some point after interruption, the arc path resistance reached a sufficiently high level that the alternating current arc could not re-ignite itself as the alternating current changed polarities. So far as is known, it has been generally accepted practice in circuit breakers to allow an arc to be established and then conditioned, or gradually cooled and lengthened, in order to interrupt a fault.

SUMMARY OF INVENTION

Briefly, the present invention provides a new and improved apparatus for controlling the opening of circuit breaker contacts while alternating current is flowing through them. The contacts are separated from each other by an operator mechanism in response to an interrupt or trip signal. The apparatus includes a sensor for sensing the phase of the alternating current flowing through the circuit breaker. According to the present invention, the phase of the alternating current is the portion or fractional pan of a 360° period through which the alternating current has cycled at a particular instant of time.

The movement of the operating mechanism which physically separates the circuit breaker contacts from each other to interrupt current flow is also monitored or sensed. A controller, usually in the form of a computer, receives indications both of the alternating current phase and of the movement of the operator mechanism. The controller regulates operator mechanism movement so that the contacts are bearing little, if any, current at the time that are physically separated from each other. In this manner, a circuit breaker need be capable of handling only a small portion of the maximum current amplitude at the time current flow is interrupted. The fault-interrupting capacity of a particular size circuit breaker is thus increased, and wear and damage to the circuit breaker contacts is reduced.

BRIEF DESCRIPTION OF THE DRAWINGS

FIG. 1 is a schematic drawing of an apparatus according to the present invention.

FIG. 2 is waveform diagram of alternating current amplitude as a function of time present in the structure of FIG. 1.

DESCRIPTION OF PREFERRED EMBODIMENT

In the drawings, a conventional high voltage circuit breaker B is shown in schematic form, having a high voltage compartment shown in phantom at H. As is conventional, the circuit breaker B is connected at insulating terminals 10 and 12 in a large alternating current power distribution network. The circuit breaker B functions both to close and also to open or trip an electrical circuit through which power is being distributed through the network.

In the compartment H, a fixed contact 14 and a moveable contact 16 are electrically connected to the terminals 10 and 12, respectively. The contacts 14 and 16 are located in an insulating medium 18 within a sealed container 20. The contacts 14 and 16 are physically pulled apart from each other by an operating mechanism 22 to break the flow of electrical current through the circuit breaker B. Similarly, the operating mechanism 22 urges the contacts 14 and 16 into connection with each other to close the electrical circuit in the breaker B. The operating mechanism 22 causes movement of the movable contact 16 through an insulator rod 24 which is moved by a pivot mechanism 26 and a linkage arm 28 whenever it is desired to either open or close the circuit breaker B.

A high level of alternating current passes through the circuit breaker B. Circuit breakers of this type have been rated according to an interrupting capacity which typically is a considerable number of kiloamperes (kA). Thus, in a high voltage distribution network rated to carry 138 kilovolts, a typical circuit breaker has in the past been designed to interrupt carrying a fault current on the order of 80 kiloamperes.

In an apparatus A according to the present invention, a computer/microprocessor 30 is connected to a current transformer 32. The current transformer 32 provides the microprocessor 30 a waveform 34 (FIG. 2) over conductor 36. Waveform 34 is a reduced level indication of the alternating current waveform flowing through the circuit breaker B. As is conventional, the alternating current waveform is composed of a repeated number of alternating positive and negative cycles separated by an amplitude zero crossings. Zero crossings as indicated at 34*a*, 34*b*, and 34*c* are sensed, either internally in the microprocessor 30 or through a separate zero crossing detector circuit and associated buffer circuit which is connected between current transformer 32 and microprocessor 30. In this manner, the phase, or angular position during a sinusoidal current waveform cycle, of the electrical current flowing through the high voltage circuit breaker B is sensed in order to form a timing reference for the apparatus A. According to the present invention, the phase of the alternating current is the portion or fractional part of a 360° period through which the alternating current has cycled at a particular instant of time.

The phase of the alternating current is thus indicative of the amount of time before or after the next amplitude zero crossing in the alternating current waveform. For sixty hertz alternating current typically present in the United States, each 180° half-cycle lasts approximately 8.3 milliseconds. A peak positive amplitude of current occurs at a phase of 90°, or about 4.16 milliseconds after each positive-going zero-crossing, such as the one indicated at 34*e*. A peak negative amplitude of current occurs at a phase of 270°, or about 4.16 milliseconds before each positive-going zero-crossing. At other frequencies, these times vary accordingly.

The computer/microprocessor 30 is also connected by a conductor 38 to the interrupt/breaker control system which exercises supervisory control over the distribution network in which the breaker B is serving. In this manner, computer 30 is provided with a signal indicative of the occurrence of an interrupt or trip signal at the same time such a signal is provided to operating mechanism 22.

An indicator 40 serves as a position or movement reference for the operating mechanism 22. The indicator 40 may take the form of an etched plate or other suitably marked mechanism with marks or lines or other suitable indicators marked fixed at spaced intervals from each other. The indicator 40 is mounted on the linkage arm 28 and moves with the linkage arm 28 when the circuit breaker B is being opened or closed.

A laser or other light source 42 focuses a beam of light onto the indicator 40 and a light detector mechanism 44 is provided to sense light reflected by the indicator plate 40 from the light or laser source 42. As the indicator lines or indicia on the indicator 40 interrupt the light pattern focused thereon from the light source 32, the light detector mechanism 44 senses such interruptions in the light pattern.

The light detector mechanism 44 is electrically connected by conductor 46 to provide input signals to the computer/microprocessor 30. By calibration measurements, the time occurrence and rate of such occurrence of interruptions in the light patterns caused by movement of indicator 40 and detected by the light detector mechanism 34 form indications of the rate of movement and total movement or displacement in linkage arm 28. These in turn indicate the position and relative movement of contact 16 with respect to contact 14 in the circuit breaker B.

The indication of movement rate and position of the contacts 14 and 16 as processed in the computer 30 to form an indication of the relative position and relative rate of movement of the linkage arm 28 driven by the operating mechanism 22. In this manner, the position and velocity of movement of the insulator rod 24 and contact 16 are measured and monitored in the computer 30. From these measurements, the computer 30 forms an indication of the rate of movement or velocity, and also the position, of the movable contact 16 of the circuit breaker B. The indications of the position and velocity of the movable contact 16 are compared in the computer 30 with the phase or angular position of the alternating current wave form flowing through the circuit breaker B.

By way of contrast, conventional prior circuit breaker contacts have typically been rated to open or trip within three or so cycles of the occurrence of a trip control signal (FIG. 2) from the network control system. The actual time occurrence of physical separation of the breaker contacts was, however, allowed to occur whenever mechanical separation of the contacts could be physically accomplished. This was done without regard to the magnitude of the current flowing in the circuit breaker B at that particular time.

With the present invention, it has been found that the contacts 14 and 16 of the circuit breaker B can be caused to open and interrupt flow of current at or very near the next occurring one of the zero crossings (such as 34*a*, 34*b* or 34*c*) of the alternating current wave form 34. In this manner, the high voltage circuit breaker B can be caused to interrupt the flow of the high voltage electrical current at twenty five percent or less of the rated maximum current flow through the circuit breaker B.

To accomplish this, the microprocessor 30 provides a control signal over conductor 48 to an electromagnetic brake 50 which is mechanically connected through a control rod 52, linkage 54 and connector arm 56 to the linkage arm 28. The control signal provided by the processor 30 to the electromagnetic brake 50 is applied to control the rate of movement and the position of the linkage arm 28. Typically, the rate of movement of linkage arm 28 is slowed or retarded. In this way, movement of the movable contact 16 with respect to the fixed contact 14 within the high voltage compartment H is slowed. The movement of contact 16 is reduced based on time calculations made in computer 30 from the phase measurements provided computer 30 from transformer 32. In effect, the parting of contacts 14 and 16 is synchronized with the phase of the current waveform 34 representative of the current waveform being interrupted in the circuit breaker B. The contacts 14 and 16 are caused to physically part from each other at or very close to the time that the phase or angular position of the load current is at an angle acceptably near zero degrees.

For example, signals presented to computer 30 indicative of the present rate of movement of linkage arm 28 at the time a trip signal is received over conductor 38 might indicate a breaker contact parture projected to occur at a time 34*d* when a phase of approximately 45° or 50° is present. At this time, the contacts 14 and 16 would be carrying about 70% to 75% of their rated maximum current. Even worse, breaker contact parture might be indicated as likely to occur at or near time 34*e*, a phase of about 90°, when a maximum amplitude current would be present.

With the present invention, the computer 30 sends signals to the brake 50 to retard or slow movement of the rod 28 to a predetermined rate so that contact parture occurs at or very near one of the next subsequent zero-crossings, such as those indicated at 34*a*, 34*b*, or 34*c*.

At these particular times, the magnitude of the current flowing through the circuit breaker B is acceptably near zero amperes. For example, by causing the contacts 14 and 16 to part from each other within ±15° from a phase of zero degrees, the current flowing through the breaker B during this time is less than about twenty five percent of the rated maximum amplitude current flowing through the circuit breaker B. Thus, the magnitude of the current flowing through the circuit breaker B at the controlled time of breaker parture is very low, and preferably at or very near zero amperes. As a result of this, the movable contact 16 and the fixed contact 14 are opened under minimum current level conditions. This greatly reduces damage to the contacts 14 and 16 and also substantially increases the fault-interrupting capability of the circuit breaker B, as well as greatly prolonging its intended service life.

The foregoing disclosure and description of the invention are illustrative and explanatory thereof, and various changes in the size, shape, materials, components, circuit elements, wiring connections and contacts, as well as in the details of the illustrated circuitry and construction and method of operation may be made without departing from the spirit of the invention.

I claim:

1. An apparatus for controlling the opening of circuit breaker contacts as they are separated from each other by an operator mechanism while alternating current is flowing through them, comprising:

means for sensing the phase of the alternating current;

means for sensing movement of the operator mechanism to interrupt the flow of current through the breaker contacts; and means for controlling movement of the operator mechanism so that the breaker contacts separate at a minimum phase of current flow.

2. The apparatus of claim 1, wherein said means for sensing phase comprises:

means for detecting zero-crossings in the alternating current; and means for measuring elapsed time from a detected zero crossing.

3. The apparatus of claim 2, wherein said means for measuring elapsed time includes:

computer means for measuring elapsed time from a detected zero crossing.

4. The apparatus of claim 1, wherein said means for sensing movement comprises:

a movement transducer for sensing movement of the operator mechanism and forming electrical signals representative of such movement.

5. The apparatus of claim 1, wherein said means for sensing movement comprises:

a movement transducer for sensing rate of movement of the operator mechanism and forming electrical signals representative of such rate of movement.

6. The apparatus of claim 1, wherein said means for sensing movement comprises:

indicator means formed on the operator mechanism and movable therewith;

sensor means for detecting a change in position of said indicator means;

means forming electrical signals indicative of detected change of position of said indicator means.

7. The apparatus of claim 6, wherein the operator mechanism includes:

a movement rod connected to one of the circuit breaker contacts; and motor means for moving said movement rod in response to a signal to interrupt the flow of electrical current through the circuit breaker contacts.

8. The apparatus of claim 1, wherein said means for controlling comprises:

computer means for receiving the sensed phase and the sensed movement of the operator mechanism; and means responsive to said computer means for controlling movement of the operator mechanism.

9. The apparatus of claim 8, wherein said means for controlling movement comprises:

brake means for slowing movement of the operator mechanism.

10. A method of controlling the opening of circuit breaker contacts as they are separated from each other by an operator mechanism while alternating current is flowing through them, comprising the steps of:

sensing the phase of the alternating current;

sensing movement of the operator mechanism to interrupt the flow of current through the breaker contacts; and controlling movement of the operator mechanism so that the breaker contacts separate at a minimum phase of current flow.

11. The method of claim 10, wherein said step of sensing phase comprises the steps of:

detecting zero-crossings in the alternating current; and measuring elapsed time from a detected zero crossing.

12. The method of claim 11, wherein said step of detecting zero crossings is performed in a computer.

13. The method of claim 10, further including the step of:

forming electrical signals representative of sensed movement of the operator mechanism.

14. The method of claim 10, wherein said step of sensing movement includes the step of:

sensing rate of movement of the operator mechanism.

15. An apparatus for controlling the opening of circuit breaker contacts as they are separated from each other by an operator mechanism while alternating current is flowing through them, comprising:

a current sensing transformer furnishing indications of zero crossings in the alternating current;

a movement detector for sensing movement of the operator mechanism;

a motion controller for moving the operator mechanism;

a computer receiving indications of zero crossings in the alternating current from said transformer and indications of operator mechanism movement, and further providing control signals to said motion controller so that the circuit breaker contacts separate from each other substantially at a time of current of alternating current zero crossing.

16. The apparatus of claim 15, wherein said movement detector includes:

an indicator on the operator mechanism and moveable therewith; and means for detecting a change in position of said indicator.

17. The apparatus of claim 16, wherein said means for detecting comprises:

means for sending radiant energy onto said indicator for reflection from it; and means for detecting changes in the reflections of radiant energy from said indicator.

18. The apparatus of claim 15, wherein said motion controller comprises:

means for moving the operator mechanism.

19. The apparatus of claim 18 wherein said motion controller further includes:

a brake mechanism for limiting movement of the operator mechanism.

20. The apparatus of claim 15, wherein said computer comprises:

a microprocessor connected to said transformer to receive indication of zero crossings in the alternating current and further connected to said movement detector to receive indications of operator mechanism movement; and said microprocessor forming control signals indicative of desired movement of the operator mechanism and furnishing the control signals to said motion controller.

* * * * *